United States Patent [19]

Boling, Jr.

[11] 4,154,408

[45] May 15, 1979

[54] FLAKING MILL ADJUSTMENT AND SHOCK ABSORBING MEANS

[75] Inventor: James F. Boling, Jr., Bartlett, Tenn.

[73] Assignee: N. Hunt Moore & Associates, Inc., Memphis, Tenn.

[21] Appl. No.: 861,871

[22] Filed: Dec. 19, 1977

[51] Int. Cl.[2] ..... B02C 4/32

[52] U.S. Cl. ..... 241/231; 241/232

[58] Field of Search ..... 241/230–234

[56] References Cited

U.S. PATENT DOCUMENTS

| | | | |
|---|---|---|---|
| 727,177 | 5/1903 | Montgomery | 241/232 |
| 3,315,902 | 4/1967 | Pollitz | 241/231 |
| 3,606,265 | 9/1971 | Cobey | 241/231 |
| 3,938,732 | 2/1976 | Schrimper et al. | 241/231 |
| 3,970,256 | 7/1976 | Ruegger et al. | 241/234 X |

*Primary Examiner*—Howard N. Goldberg

*Attorney, Agent, or Firm*—John R. Walker, III

[57] ABSTRACT

A device for normally maintaining a predetermined, set spacing between two associated flaking rollers of a flaking mill and for allowing the two rollers to spread apart from one another if unflakable material of a size larger than the predetermined, set spacing between the two rollers is fed therebetween. A hydraulic piston having a manually adjustable stop is mounted between the two rollers so as to maintain a predetermined, set spacing between the two rollers. A gas piston is associated with the hydraulic piston to act as a shock absorber if any unflakable material of a size larger than the predetermined, set spacing between the two rollers is fed therebetween to allow the two rollers to spread apart. The gas piston is preloaded to a pressure substantially greater than the pressure normally required to flake the material being fed between the two rollers.

8 Claims, 5 Drawing Figures

11
65
67
68
39a
35
39
41
43a
43
53
55
51
43b
49b
63
59
57
61
45b
45
37
49
49a
45a
47
81
IV
83
87
75

37
49
47
85
83
87
75

85
V
87
83
37
81

FLAKING MILL ADJUSTMENT AND SHOCK ABSORBING MEANS

BACKGROUND OF THE INVENTION

1. Field of the Invention

This invention relates generally to mills having two associated rollers for crushing, flaking, etc., material therebetween and more specifically to means for controlling the spacing between two such rollers.

2. Description of the Prior Art

Heretofore, various means have been utilized to maintain a desired spacing between two associated rollers of a mill such as a flaking mill and to allow the two rollers to spread apart from one another in case of an overload or the like. See, for example, Peters, U.S. Pat. No. 2,794,603; Kautz, U.S. Pat. No. 3,099,406; Pollitz, U.S. Pat. No. 3,315,902; Gundlach, U.S. Pat. No. 3,417,928; Alciati, U.S. Pat. No. 3,587,986; Lillig, U.S. Pat. No. 3,845,906; Bergendahl, U.S. Pat. No. 3,885,465; and Schrimper, U.S. Pat. No. 3,938,732. None of the above patents disclose or suggest the present invention.

SUMMARY OF THE INVENTION

The present invention is directed towards improving the prior means utilized for adjusting the spacing between two associated rollers of a flaking mill and for absorbing overload shocks which may be applied to the two rollers. The concept of the present invention is to position separate gas and hydraulic piston means between the two associated rollers of a flaking mill, mechanically couple the two piston means together, set the desired spacing between the two rollers with the hydraulic piston means, and preload the gas piston means to a pressure greater than the hydraulic piston means and substantially greater than the normal operating pressure needed the flake the feed stock so that normal operation of the flaking mill can be carried out with minimum movement of the two rollers relative to one another due to variation in feed stock.

DESCRIPTION OF THE PREFERRED EMBODIMENTS

Figure 1:
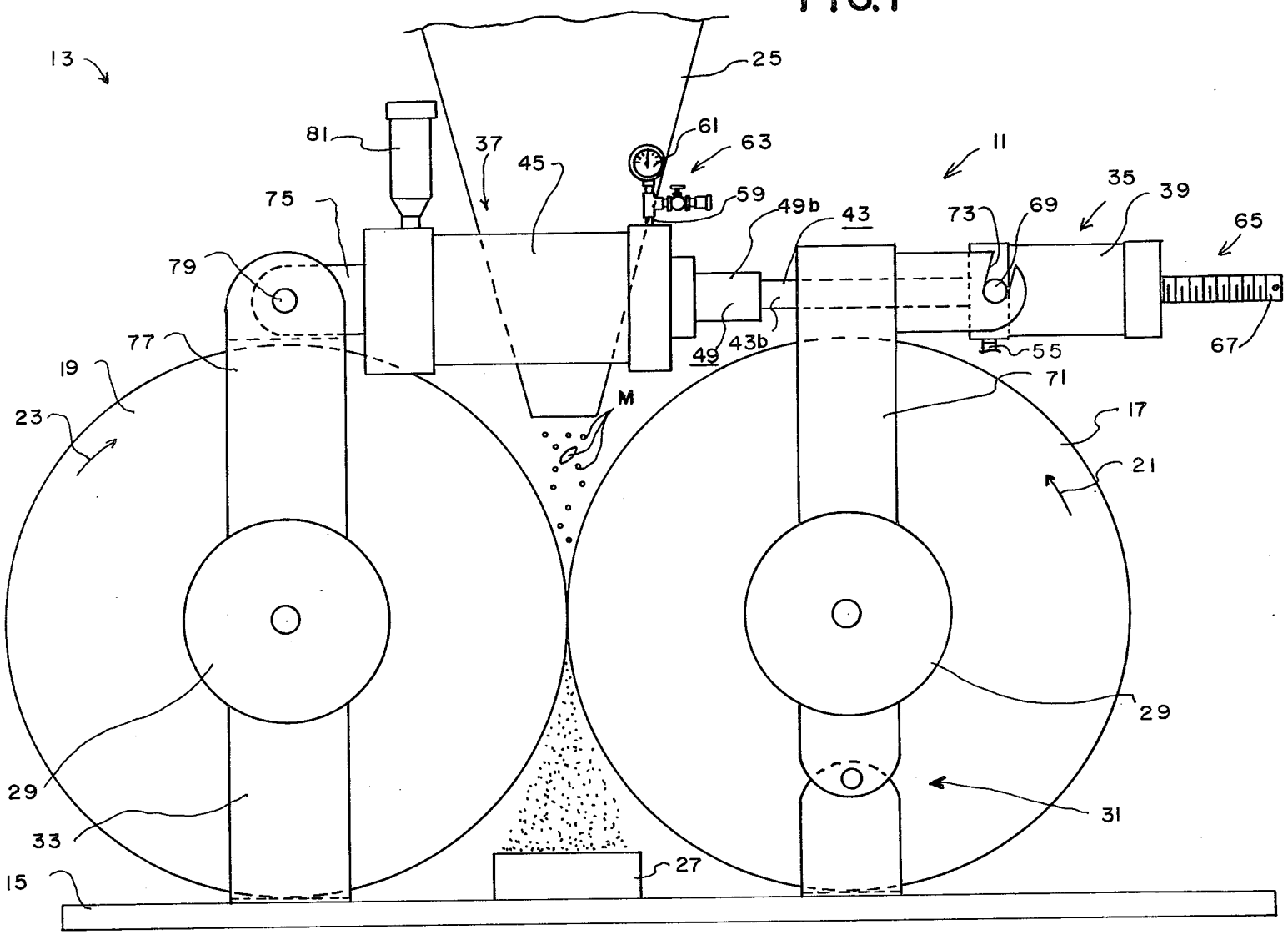
FIG. 1 is a somewhat diagrammatic front elevational view of the flaking mill adjustment and shock absorbing means of the present invention shown attached to a flaking mill.

The adjustment and shock absorbing means 11 of the present invention is for use with any mill of the type including first and second axially aligned, rotatably driven rollers for crushing, flaking, etc., material such as oil seeds (e.g., soybeans, linseed, etc.) and the like. The means 11 is specifically adapted for use in combination with a flaking mill 13 (FIG. 1) which includes a frame 15, a first roller 17 and a second roller 19 rotatably mounted to the frame 15 in position substantially axially aligned with one another so that any flakable material M fed therebetween will be flaked in a manner apparent to those skilled in the art and driven in opposite directions as indicated by the arrows 21, 23 of FIG. 1 by means (not shown) well known to those skilled in the art, and means such as the feed hopper 25 for feeding or otherwise allowing material to pass between the first and second rollers 17, 19. A recepticle 27 or the like may be positioned beneath the first and second rollers 17, 19 for receiving the material after it has passed between the first and second rollers 17, 19 and has thereby been flaked. At least one of the rollers 17, 19 is movably attached to the frame 15 so that the spacing between the first and second rollers 17, 19 can be varied. For example, each roller 17, 19 includes a bearing housing 29 at either end thereof (only one end thereof being shown in the drawings). The bearing housings 29 of the first roller 17 may be pivotally attached to the frame 15 by way of a hinge-like arrangement 31 (FIG. 1) thereby allowing the first roller 17 to pivot towards or away from the second roller 19 as should now be apparent to those skilled in the art. The bearing housings 29 of the second roller 19 may be rigidly non-movably attached to the frame 15 by way of a support member 33 (FIG. 1).

Figure 3:
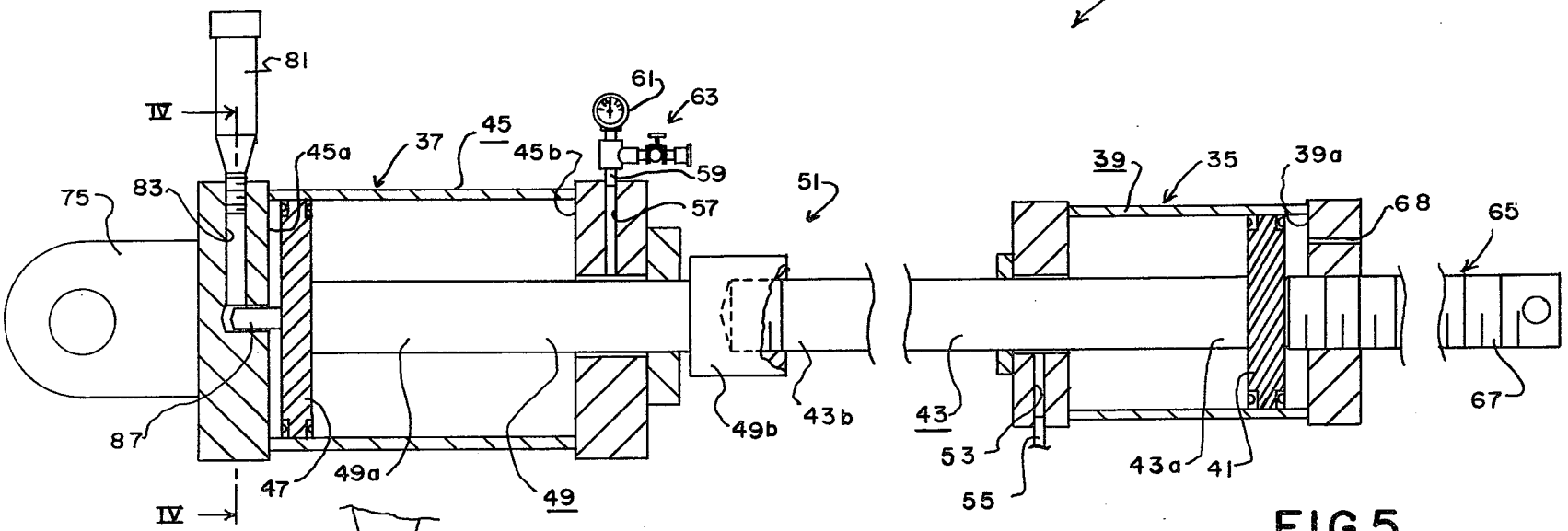
FIG. 3 is a sectional view of the means shown in FIG. 1.
Figure 5:
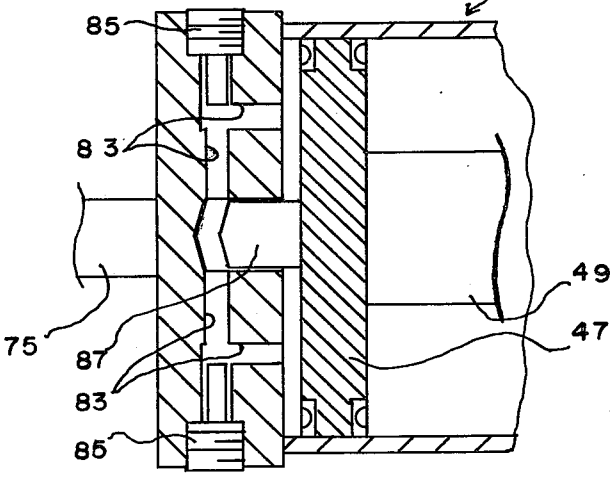
FIG. 5 is a sectional view as taken on line V—V of FIG. 4.
Figure 4:
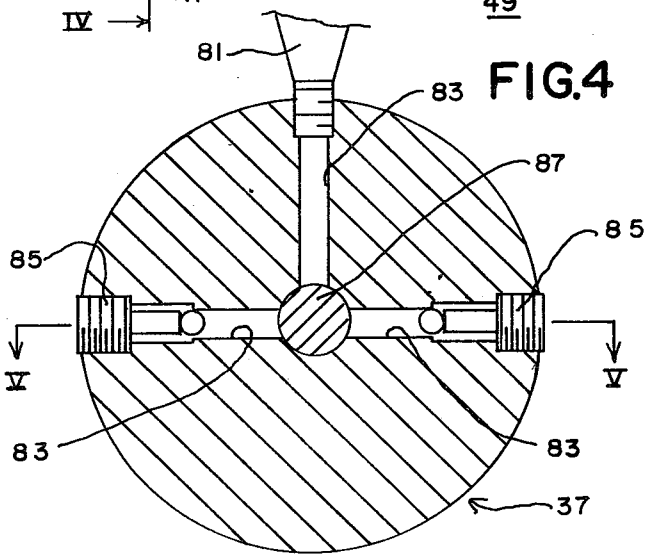
FIG. 4 is a sectional view as taken on line IV—IV of FIG. 3.

The adjustment and shock absorbing means 11 includes a hydraulic piston means 35 and a pneumatic piston means 37. In one embodiment of the present invention (FIGS. 1, 3, 4 and 5) the hydraulic piston means 35 includes a hollow housing member 39 for being attached to the first roller 17, includes a piston head 41 (FIG. 3) slidably mounted within the piston housing 39, and includes a piston rod 43 having a first end **43*a* (FIG. 3) attached to the piston head 41 and having a second end 43*b* extending outward of the piston housing 39. The pneumatic piston means 37 preferably includes a hollow piston housing 45 for being attached to the second roller 19, a piston head 47 (FIG. 3) slidably positioned in the piston housing 45, and a piston rod 49 having a first end 49*a* (FIG. 3) fixedly attached to the piston head 47 and having a second end 49*b* extending outward of the piston housing 45. The second end 43*b*, 49*b* of the piston rods 43, 49 of the hydraulic and pneumatic piston means 35, 37 are fixedly attached together to thereby mechanically couple the hydraulic and pneumatic piston means 35, 37 together. For example, the second end 43*b* of the piston rod 43 may include an externally threaded portion and the second end 49*b* of the piston rod 49 may include an internally threaded socket for receiving the externally threaded portion of the piston rod 43 as shown at 51 in FIG. 3. The hydraulic piston means 35 includes a hydraulic fluid port 53 for allowing hydraulic fluid to be introduced into the interior of the piston housing 39 so as to force the piston head 41 towards the first end 39*a* of the piston housing 39 as shown in FIG. 1. The port 53 may be of any construction apparent to those skilled in the art. A hydraulic fluid line 55 or the like is coupled to the port 53 and to any typical source of pressurized hydraulic fluid (not shown) to allow pressurized hydraulic fluid to be introduced to the port 53. The pneumatic piston means 37 includes a pneumatic gas port 57 (FIG. 3) for allowing pneumatic gas to be introduced into the interior of the piston housing 45 so as to force the piston head 47 towards the first end 45*a* of the piston housing 45 as shown in FIG. 3. The port 57 may be constructed in any manner apparent to those skilled in the art. The pneumatic gas line 59 is coupled to the port 57 and to any typical source of pressurized pneumatic gas (not shown) so as to allow pressurized pneumatic gas to be introducted into the port 57. The pneumatic gas is preferably nitrogen and pressure of up to 1,200 psi is maintained in the pneumatic piston means 37 so as to normally cause the piston head 47 to bottom out at the first end 45***a* of the piston housing 45. A gauge 61 and a fill valve 63 (FIG. 3) may be provided to maintain such pressure in a manner as should now be apparent to those skilled in the art. The hydraulic fluid within the hydraulic piston means 37 is maintained at a pressure about 200 psi below the pneumatic pressure within the pneumatic piston means 37. Such pressure would normally cause the piston head 41 to bottom out at the first end 39*a* of the piston housing 39. However, the hydraulic piston means 35 preferably includes a manual adjustment means 65 for allowing manual adjustment of the spacing between the first and second rollers 17, 19 in a manner which will hereinafter become apparent. The manual adjustment means 65 may consist merely of a screw member 67 which passes through the first end 39*a* of the piston housing 39 and which can be manually screwed in and out relative to the first end 39*a* of the piston housing 39 to vary the effective length of the adjustment and shock absorbing means 11 in a manner which should now be apparent to those skilled in the art. An air vent port 68 (FIG. 3) is provided in the first end 39*a* of the piston housing 39 to allow air to pass therethrough when the piston head 41 is moved as should now be apparent to those skilled in the art. Various seals are provided in the piston means 35, 37 to seal the hydraulic and pneumatic fluid in a manner which should be apparent to those skilled in the art.

The piston housing 39 preferably includes trunnion pins 69 (FIG. 1) for use in attaching the hydraulic piston means 35 to the first roller 17. More specifically, an upstanding support member 71 is preferably fixedly attached to the bearing housing 29 of the first roller 17 (FIG. 1). The support member 71 includes a slot 73 in its upper end for receiving the trunnion pins 69 of the hydraulic piston means 35 to thereby attach the hydraulic piston means 35 to the first roller 17 in a manner which compensates for the pivotal movement of the first roller means 17. The pneumatic piston means 37 may include an eye bracket 75 attached to the outer end thereof for aid in attaching the pneumatic piston means 37 to the second roller 19. An upstanding support member 77 is preferably fixedly attached to the bearing housing 29 of the second roller 19 and pivotally attached to the eye bracket 75 by way of a pin 79 to thereby attach the pneumatic piston means 37 to the second roller 19 (FIG. 1).

When thus made and used, the adjustment and shock absorbing means 11, under normal running conditions, causes both rollers 17, 19 to remain fixed relative to one another with a constant gap therebetween. The hydraulic and nitrogen pressure should be approximately twice the specific pressure required to flake the material M being fed between the rollers 17, 19 with consideration being given to the length of the rollers 17, 19, the capacity of the flaking mill 13, the condition of the feed material, and the double point pivot radius of the bearing arrangement. When non-flakable, non-compressible material is fed between the rollers 17, 19 and creates sufficient pressure to overcome the pressure of the nitrogen in the pneumatic piston means 37, the piston head 47 will be drawn towards the second end 45*b* of the piston housing 45, causing the nitrogen gas within the piston housing 45 to compress and allowing the first roller 17 to move away from the second roller 19 thereby allowing the non-flakable, non-compressible material to pass therebetween. Once such non-flakable, non-compressible material passes between the rollers 17, 19, the pneumatic pressure within the pneumatic piston means 37 will again force the piston head 47 to bottom out against the first end 45*a* of the piston housing 45. The pneumatic piston means 37 may include a hydraulic damping means to absorb some of the energy created by compressing the pneumatic gas within the pneumatic piston means 37 thereby allowing the piston head 47 to slowly bottom out against the first end 45*a* of the piston housing 45. Such a hydraulic damping means is disclosed on page 25 of Bulletin No. 4908-1175, Copyright 1975, of the Miller Fluid Power Corporation, 7NO15 York Road, Bensenville, Ill. 60106. In general, the hydraulic damping means includes a hydraulic fluid reservoir 81, a hydraulic fluid port 83 provided in the first end 45*a* of the piston housing 45 (FIGS. 3, 4 and 5), valve means 85 provided within the port 83 for restricting the passage of hydraulic fluid back to the reservoir 81, and a plunger 87 attached to the outer end of the piston head 47. The operation of the hydraulic damping means should now be apparent to those skilled in the art. Basically, when the piston head 47 is drawn towards the second end 45*b* of the piston housing 45 due to non-flakable, non-compressible material passing between the rollers 17, 19, hydraulic fluid will be drawn from the reservoir 81 through the port 83 into the piston housing 45. When the non-flakable, non-compressible material passes through the rollers 17, 19 the compressed pneumatic gas will force the piston head 47 towards the first end 45*a* of the piston housing 45 and the hydraulic damping means will absorb some of the energy created by the compressed pneumatic gas to thereby hydraulically damp the return stroke of the pneumatic piston means 37.

Figure 2:
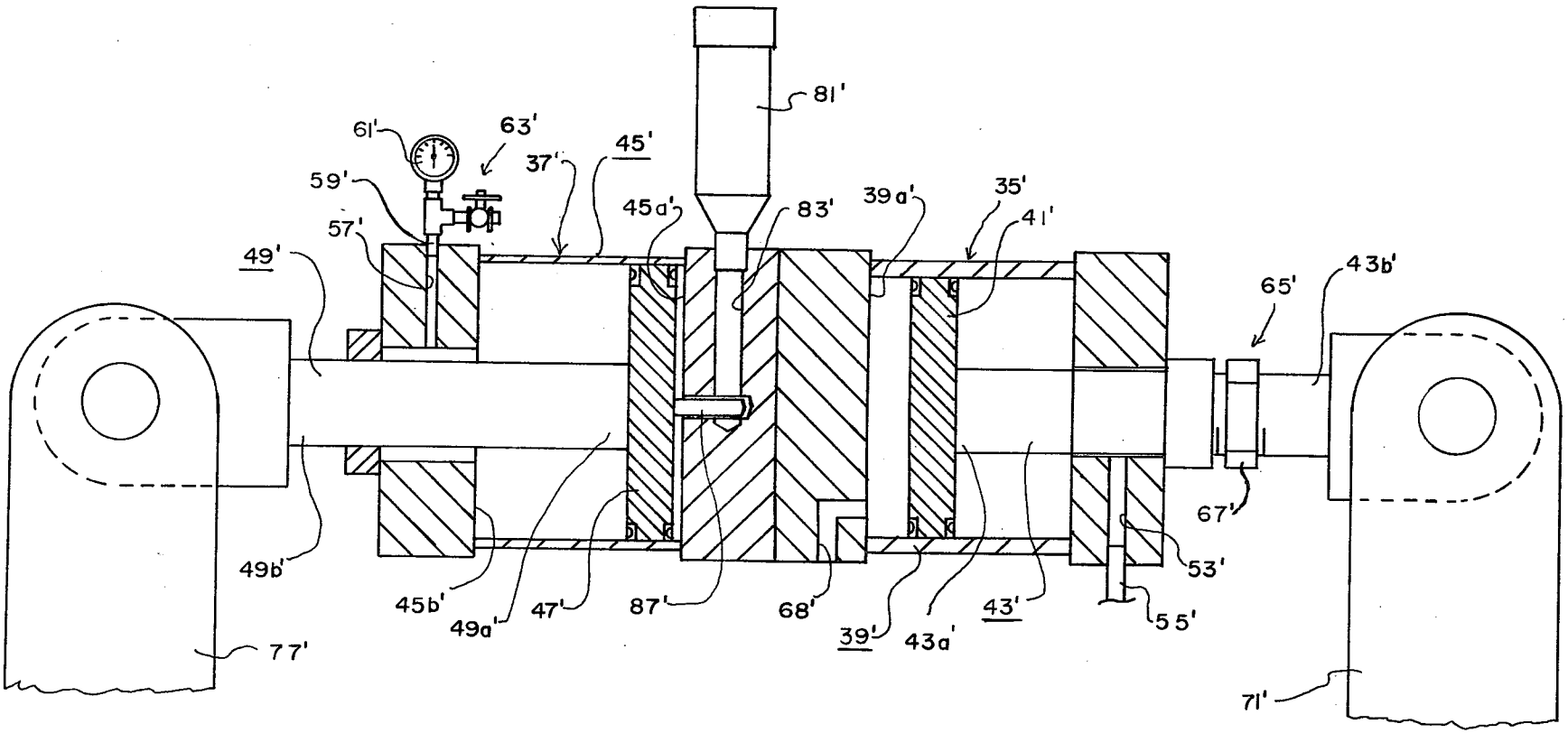
FIG. 2 is a partially sectional view of an alternate embodiment thereof.

A second embodiment of the adjustment and shock absorbing means 11 is shown in FIG. 2 and is identified by the numeral 11'. The adjustment and absorbing means 11' is substantially similar to the adjustment and shock absorbing means 11 and includes a hydraulic piston means 35' and a pneumatic piston means 37' substantially identical to the hydraulic piston means 35 and pneumatic piston means 37. However, rather than being mechanically associated together by means of the piston rod 43', 49', the piston housings 39', 45' are fixedly attached to one another, back to back. The adjustment and shock absorbing means 11' is attached to the support members 71', 77' of the rollers 17, 19 by way of the piston rods 43', 49'. In all other respects the adjustment and shock absorbing means 11' is substantially identical to the adjustment and shock absorbing means 11 and includes, among other things, a piston housing 39' having a first end 39*a'*, a piston head 41', a piston rod 43' having a first end 43*a'*45' having first and second ends 45*a'*, 45*b'*, a piston head 47'; a piston rod 49' having first and second ends 49*a'*, 49*b'*, a hydraulic fluid port 53', a hydraulic fluid line 55', a pneumatic gas port 57', a pneumatic gas line 59', a gauge 61', a fill valve 63', an air vent port 68', and preferably including, in general, a hydraulic fluid reservoir 81', a hydraulic fluid port 83' and a plunger 87'. The operation a construction of these components are substantially idential to those of the adjustment and shock absorbing means 11 and the above description thereof suffice for a description of the adjustment and shock absorbing means 11'. The adjustment and shock absorbing means 11' includes a manual adjustment means 65' which performs the same function as the manual adjustment means 65. The manual adjustment means 65' includes a nut member 67' threadingly mounted on the piston rod 43' for acting as an adjustable stop in a manner which should now be apparent to those skilled in the art so as to vary the effective length of the hydraulic piston means 39'.

Although the invention has been described and illustrated with respect to preferred embodiment thereof, it is not to be so limited since changes and modifications may be made therein which are within the full intended scope of the invention.

I claim:

1. In a flaking mill of the type including a frame, first and second driven rollers rotatably mounted to said frame in positions substantially axially with one another, said first roller being movable relative to said second roller for allowing the spacing between said first and second rollers to be varied, and feed means for allowing material to be fed between said first and second roller, the combination with said first and second rollers of: means for maintaining the spacing between said first and second rollers in such a manner that any flakable material fed between said first and second rollers will be flaked and for allowing said first roller to move away from said second roller if any non flakable material of a size larger than the set spacing between said first and second rollers is fed therebetween, said means for maintaining the spacing between said first and second rollers including a hydraulic piston means having a first piston member attached to said first roller and having a second piston member movably attached to said first piston member, said means for maintaining the spacing between said first and second rollers further including a pneumatic piston means having a first piston member attached to said second roller and having a second piston member movably attached to said first piston member thereof, said second piston members of said hydraulic and pneumatic piston means being attached to one another for movement together, said hydraulic piston means including a hydraulic fluid under pressure for normally forcing said first and second piston members thereof together, said pneumatic piston means including a pneumatic fluid under pressure for normally forcing said first and second piston members thereof together, said pneumatic fluid being under a higher pressure than said hydraulic fluid.

2. The combination of claim 1 in which said pneumatic fluid is under a pressure substantially greater than the pressure normally required to flake said material being fed between said first and second rollers.

3. The combination of claim 2 in which said hydraulic piston means includes manual adjustment means for allowing manual adjustment of the spacing between said first and second rollers.

4. The combination of claim 2 in which said first member of said hydraulic piston means includes a hollow piston housing, in which said second member of said hydraulic piston means includes a piston head slidably mounted in said piston housing and further includes a piston rod having a first end fixedly attached to said piston head of said second member of said hydraulic piston means and having a second end extending outward of said piston housing of said hydraulic piston means, in which said first member of said pneumatic piston means includes a hollow piston housing, in which said second member of said pneumatic piston means includes a piston head slidably mounted in said piston housing of said first member of said pneumatic piston means and includes further a piston rod having a first end fixedly attached to said piston head of said second member of said pneumatic piston means and having a second end extending outward of said piston housing of said first member of said pneumatic piston means, and in which said second ends of said piston rods of said hydraulic and pneumatic piston means are fixedly attached to one another.

5. The combination of claim 4 in which said pneumatic piston means includes a hydraulic damping means for slowing down the return stroke of said pneumatic piston means.

6. The combination of claim 2 in which said second member of said hydraulic piston means includes a hollow piston housing, in which said first member of said hydraulic piston means includes a piston head slidably mounted in said piston housing and further includes a piston rod having a first end fixedly attached to said piston head of said first member of said hydraulic piston means and having a second end extending outward of said piston housing of said hydraulic piston means, in which said second member of said pneumatic piston means includes a hollow piston housing, in which said first member of said pneumatic piston means includes a piston head slidably mounted within said piston housing of said pneumatic piston means and includes a piston rod having a first end fixedly attached to said piston head of said first member of said pneumatic piston means and having a second end extending outward of said piston housing of said second member of said pneumatic piston means, and in which said piston housings of said hydraulic and pneumatic piston means are fixedly attached to one another.

7. The combination of claim 6 in which said pneumatic piston means includes a hydraulic damping means for slowing down the return stroke of said pneumatic piston means.

8. An improved flaking mill adjustment and shock absorbing means of the type for attachment to at least one roller of a flaking mill to maintain a desired spacing between said at least one roller and another roller of the flaking mill and to allow the two rollers to spread apart from one another in case of an overload, wherein said improvement comprises:

(a) a hydraulic piston means having a first piston member attached to one of said rollers of said flaking mill and having a second piston member movably attached to said first piston member thereof, said hyraulic piston means including a hydraulic fluid under pressure for normally forcing said first and second piston members thereof together; and (b) a pneumatic piston means having a first piston member attached to the other of said rollers of said flaking mill and having a second piston member movably attached to said first piston member thereof, and pneumatic fluid under pressure for normally forcing said first and second piston members thereof in said pneumatic piston means together, said second piston members of said hydraulic and pneumatic piston means being attached to one another for movement together.

* * * * *